United States Patent [19]

Gibitz

[11] 4,441,619

[45] Apr. 10, 1984

[54] TOOL HOLDER COMBINATION

[76] Inventor: Ernest L. Gibitz, 86 Elinor Ave., Akron, Ohio 44305

[21] Appl. No.: 383,810

[22] Filed: Jun. 1, 1982

[51] Int. Cl.[3] ..... A47F 5/08

[52] U.S. Cl. ..... 211/60 T; 211/59.1; 248/220.4; 248/222.1

[58] Field of Search ..... 211/57.1, 59.1; 248/220.3, 220.4, 221.2, 222.1; 411/386

[56] References Cited

U.S. PATENT DOCUMENTS

| | | | |
|---|---|---|---|
| 3,286,579 | 11/1966 | Lovisek | 411/386 |
| 3,965,793 | 6/1976 | Roser | 411/386 |
| 4,308,961 | 1/1982 | Kunce | 211/57.1 X |

FOREIGN PATENT DOCUMENTS

| | | | |
|---|---|---|---|
| 2640423 | 3/1977 | Fed. Rep. of Germany | 248/221.2 |
| 223684 | 11/1968 | Sweden | 248/221.2 |

*Primary Examiner*—Ramon S. Britts

*Assistant Examiner*—Robert W. Gibson, Jr.

*Attorney, Agent, or Firm*—Reese Taylor

[57] ABSTRACT

A tool holder combination for use with a perforated support panel includes an elongate plate having front and rear surfaces and at least two panel engaging hooks pressed from and projecting from the rear surface adjacent the opposed ends for engagement with adjacent perforations in the support panel. The plate includes an integral, offset center portion disposed parallel to the plane of the front surface of the plate and which occupies approximately fifty percent of the overall length of the plate. The offset center portion also contains a through screw receiving aperture adjacent one end of the offset portion and the combination includes a self-threading, tapered screw having a relatively deep thread which is intended to pass through the screw receiving aperture and engage the edge of a perforation on the support panel when the panel engaging hooks are in engagement therewith to draw the plate toward the support panel and securely anchor it thereon.

2 Claims, 4 Drawing Figures

TOOL HOLDER COMBINATION

FIELD OF THE INVENTION

This invention relates, in general, to wall mounted systems for storing and holding parts or tools and relates in particular to an improved tool holder combination for use with a tool or part storage installation of the type including a perforated support panel and means for engaging the perforations to suspend tool or part engaging members therefrom.

DESCRIPTION OF THE PRIOR ART

The prior art pertinent to this particular invention essentially involves systems for storing parts or tools for ready access. Systems of the type involved herein usually include a wall mounted, rigid, support panel, usually made of metal, and having a series of perforations in a symmetrical pattern of square holes. The panel may be reinforced on its reverse side by metal strips which can also provide fixing points for attachment to a wall, bench, or other supporting surface.

The prior art systems also include a variety of plates of diverse configuration, all of which, however, have certain common features. Essentially, those features are that each support plate has at least two panel engaging hooks pressed from and projecting from the rear surface thereof so that the hooks may engage adjacent perforations of the support panel to suspend the plate on the panel. As noted, these plates take diverse configurations but all have this basic feature.

The plates in the prior art also are essentially uniform in that they have an integral central offset portion which projects from the front face of the plate and which generally receives, in projecting fashion, a hook, tray, snap, or other type of tool or part engagement device. In this fashion, the prior art teaches that the plates can be snapped into the perforations on the panel and then the tool can be engaged with the projecting member.

An improvement on this basic prior art involves the utilization of a simple machine screw which is passed through an aperture in the plate surface and thus into one of the perforations on the panel, thereby presumably engaging, with its threads, an edge of the perforation to prevent accidental removal of the plate from the panel. An example of this just described prior art can be seen in FIGS. 1 and 2 of the drawings of this application, as will subsequently be described more fully.

SUMMARY OF THE INVENTION

While the aforementioned prior art has been found to be advantageous and capable of performing its intended function, it has been discovered that an apparently slight, but practically significant, modification can produce substantially increased and improved results.

Thus, it has been discovered that if the offset portion of the plate is elongate so as to occupy essentially, approximately fifty percent of the overall length of the plate, that the "hinge" point of the plate can be significantly lowered relative to the support point of the tool or part engagement device, thereby significantly increasing the amount of weight which can be supported. This is in contrast to the prior art which, generally speaking, employs an offset portion occupying only approximately twenty percent of the overall length of the plate. With such design, the hinge point, which is the point at which the offset portion joins the main portion of the plate body, is located such that much lesser weight can be supported.

It has also been discovered that the basic machine screw employed in the prior art, while presumably effective for the purpose for which it is designed, can be replaced with a self-threading tapered screw having a much deeper thread and a greater pitch so that greater engagement with the edge of the perforation of the panel can be achieved, thus providing greater holding power.

Finally, it has been discovered that if the screw receiving aperture is formed in the offset central portion of the plate itself, that utilization of that location of the thread receiving aperture together and in combination with the self-threading tapered screw just described, will permit the plate to be drawn into firm engagement with the supporting panel, thereby significantly improving the holding power of the combination.

Accordingly, production of an improved tool holder combination of the type above described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENT

Figure 1:
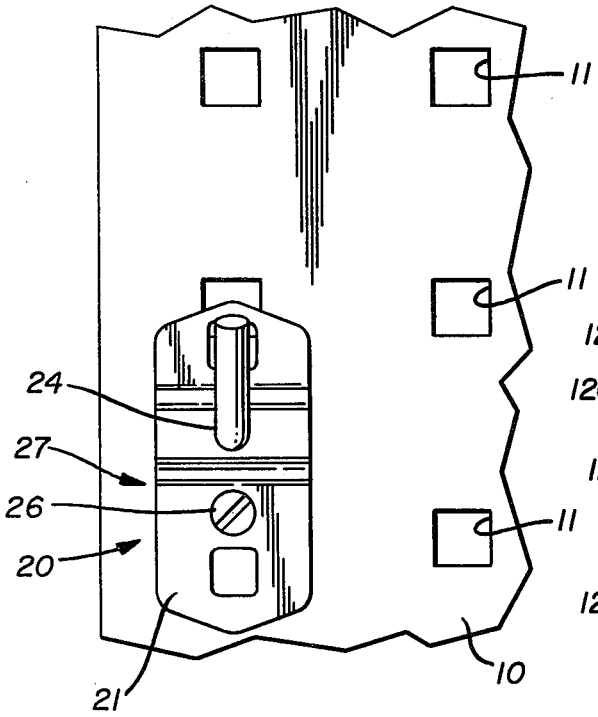
FIG. 1 PRIOR ART
FIG. 1 is a front elevational view of the prior art tool holder combination showing the combination in place on a typical support panel.
Figure 2:
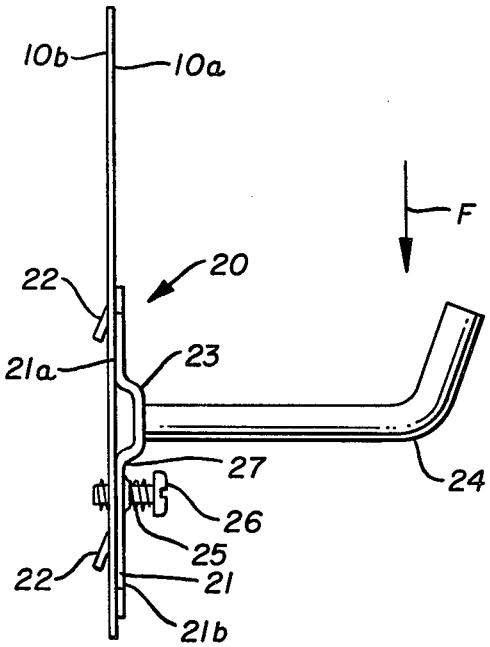
FIG. 2 PRIOR ART
FIG. 2 is a side elevational view of the tool holder combination of the prior art illustrated in FIG. 1.

Referring then first to FIGS. 1 and 2 of the drawings, as noted, these figures illustrate the prior art best known to Applicant.

As previously discussed, the present invention is concerned with a tool holder combination of the type intended to be used on a rigid support panel having a series of perforations therein, generally arranged in a symmetrical pattern of square holes. To that end, in FIG. 1, the support panel, generally indicated by the numberal 10, has a plurality of square holes or perforations 11,11. These are through perforations and extend from the front face **10*a* to the rear face 10*b* of the panel 10**.

Still referring to FIGS. 1 and 2 and still describing the prior art, the tool holder combination, generally indicated by the numeral 20, includes a plate 21 which is generally elongate and which has panel engaging projecting hooks 22,22 pressed from the plate 21 and projecting from the rear surface **21*a* thereof. The dimensions of the plate 21 and the location of the hooks 22,22 are such that these hooks are capable of engaging adjacent perforations 11,11 in the panel 10** as clearly shown in FIG. 2 of the drawings.

The prior art plate 21 also includes a central offset portion 23 which is raised from and lies in a plane parallel to the plane of the front surface **21*b* of the plate 21. Projecting from this raised portion 23 is a tool or part engagement device 24 which is soldered, welded, or otherwise secured to the central portion 23**.

Still referring to FIG. 2, it will be noted that the plate 21 has a through aperture 25 which receives a machine screw 26. The machine screw thus, as clearly shown in the drawings, is adapted to pass through the aperture 25 to presumably engage the edge of one of the perforations 11 of the panel 10.

Figure 3:
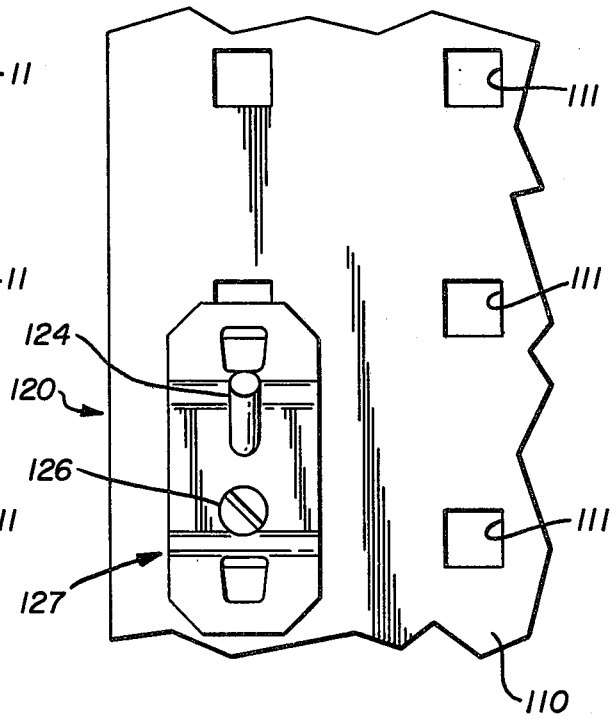
FIG. 3 is a view similar to FIG. 1 showing the improved tool holder combination of this invention.
Figure 4:
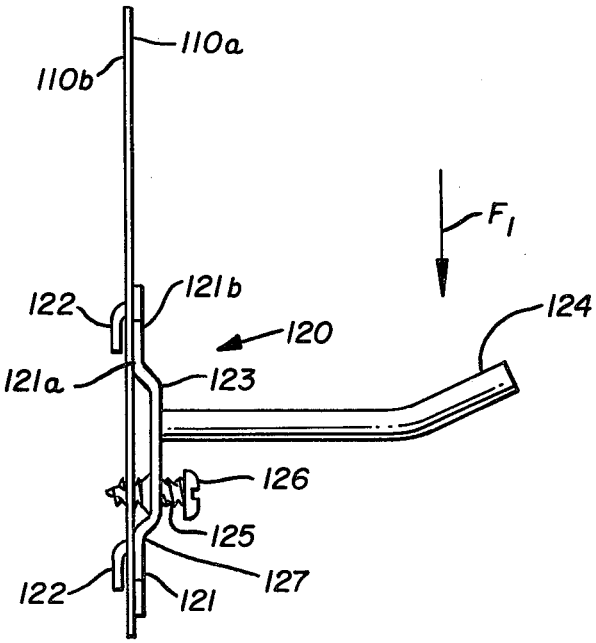
FIG. 4 is a view similar to FIG. 2 showing the improved tool holder combination of this invention.

Two things should be noted with regarded to this prior art before turning to a description of the present invention which is illustrated in FIGS. 3 and 4. First, the length dimension of the offset portion 23 is relatively small with regard to the overall dimension of the plate. In most of the prior art, this dimension is somewhere in the order of twenty percent.

Second, it will be noted that when a force is applied to the tool or part engagement device 24 in the direction of the arrow F (see FIG. 2), a hinge point will be set up at 27. In other words, the force in the direction of the arrow F will at least attempt to bend the plate about the line 27.

Turning then to FIGS. 3 and 4 of the drawings for a description of the improvement of the present invention, similar components will be designated by similar numerals in the 100 series.

Accordingly then, and referring to FIGS. 3 and 4, it will be noted that again, a support panel 110 is illustrated having a plurality of through square perforations 111,111. The improved combination 120 also again includes an elongate plate 121 having front and rear surfaces 121*a* and 121*b*.

At least two panel engaging hooks 122,122 are pressed from the plate 121 and project from the rear surface 121*a* thereof for engagement with the perforations 111,111 of the panel 110 as clearly shown in FIG. 4 of the drawings.

Again, the plate 121 is constructed with a central offset portion 123 lying in a plane parallel to the front surface 121*b*. Here, however, the central offset portion 123 occupies approximately fifty percent of the overall length of the plate 121, which produces significant advantages as will be described below.

Completing a description of the improved combination 120, it will be noted that a tool or part engaging device 124 projects from the central offset portion 123 and that an aperture 125 is provided in the central portion for receipt of the screw 126.

It will be noted, in comparing the prior art of FIGS. 1 and 2 with the improvement of FIGS. 3 and 4, that there are several significant differences.

First, as already mentioned, the central offset portion 123 of the invention occupies a significantly greater percentage of the overall length of the plate 120 than does the central offset portion 23 of FIG. 2. Thus, when a force, or weight, applied in the direction of the arrow $F_1$ is applied to the tool or part engaging device 124 of the invention, the hinge line 127 is disposed a significantly different distance from the axis of the tool or part engaging device 124 thereby enabling the combination 120 to support significantly greater weight than the combination 20 of the prior art.

Second, it will be noted that the screw 26 of the prior art is a basic machine screw while the screw 126 of the invention is a self-threading tapered screw having a relatively deep thread and thread pitch. This enables the screw 126 to pull the offset portion of the plate toward the front face 110*a* of the panel 110, thereby securing the plate 121 much more securely to the panel 110 than is the case with the plate 21 of the prior art.

Third, it will be noted that the screw 126 of the invention is passed through aperture 125 in the plate 121 which is located in the offset central portion 123 itself. This also serves to pull the offset portion 123 toward the panel 110 which is not possible with the prior art.

While a full and complete description of the invention has been set forth in accordance with the dictates of the Patent Statutes, it should be understood that modifications can be resorted to without departing from the spirit hereof or the scope of the appended claims.

In that regard, it should be noted that both the prior art and the improvement have been illustrated and described as having a pair of opposed panel engaging hooks. The invention is not intended, in any way, to be limited to only two such hooks on any given plate.

Similarly, a particular kind of tool or part engaging device 24 and 124 has been illustrated in both the prior art and the improvement. It should be understood that this element can take many different shapes or configurations and can include rather than the hook which is illustrated, a clip, a tray, a double hook, etc.

Finally, it should be noted that while certain relative dimensions have been mentioned in this specification, that it is the relative dimensions that is significant and not the absolute dimensions. In other words, the plates could be of sufficient size so that the hooks 122,122 would not necessarily engage adjacent perforations 111,111 but could, for example, engage alternate perforations in the panel 110. However, of course, the offset portion 123 would be expanded in such a situation so as to maintain the ratio between its length and the overall length of the plate 121.

What is claimed is:

1. A tool holder combination for use with a perforated support panel, comprising:

(A) an elongate plate having tool engagement means and having front and rear surfaces and two integral panel engaging hooks projecting from the rear surface adjacent opposed ends thereof;

(B) said plate having a through screw receiving aperture located between said panel engaging hooks;

(C) a self-threading, tapered screw having a relatively deep thread;

(D) said screw being adapted to pass through said screw receiving aperture of said plate and into one of the perforations of the support panel and engage the periphery of the perforation when said panel engaging hooks are in engagement with the panel;

(E) said plate having top and bottom portions and a central support portion offset therefrom and disposed in a plane parallel to the plane of the front surface thereof;

(F) said central support portion having a length approximating one half the overall length of said plate; and (G) said screw drawing the rear surfaces of said top and bottom portions into engagement with the panel and said central support portion toward the panel upon engagement with the periphery of the panel perforation, and (H) said screw receiving aperture being disposed in said offset portion of said plate.

2. The tool holder of claim 1 wherein at least one tool engaging device projects from the front surface of said plate.

* * * * *